United States Patent [19]

Schmidt-Hatting

[11] 4,224,127

[45] Sep. 23, 1980

[54] ELECTROLYTIC REDUCTION CELL WITH COMPENSATING COMPONENTS IN ITS MAGNETIC FIELD

[75] Inventor: Wolfgang Schmidt-Hatting, Chippis, Switzerland

[73] Assignee: Swiss Aluminium Ltd., Chippis, Switzerland

[21] Appl. No.: 60,922

[22] Filed: Jul. 26, 1979

[30] Foreign Application Priority Data

Aug. 4, 1978 [CH] Switzerland ..... 8356/78

[51] Int. Cl.[2] ..... C25C 3/16

[52] U.S. Cl. ..... 204/243 M; 204/244

[58] Field of Search ..... 204/67, 243 M, 244, 204/245–247

[56] References Cited

U.S. PATENT DOCUMENTS

| | | | |
|---|---|---|---|
| 3,756,938 | 9/1973 | Nebell | 204/243 M |
| 3,775,280 | 11/1973 | Nikiforov et al. | 204/243 M |
| 3,775,281 | 11/1973 | Schmidt-Hatting | 204/243 M X |
| 4,132,621 | 1/1979 | Morel et al. | 204/243 M |

FOREIGN PATENT DOCUMENTS

| | | | |
|---|---|---|---|
| 2308556 | 10/1973 | Fed. Rep. of Germany | 204/244 |
| 434135 | 10/1974 | U.S.S.R. | 204/244 |

*Primary Examiner*—John H. Mack
*Assistant Examiner*—D. R. Valentine
*Attorney, Agent, or Firm*—Bachman and LaPointe

[57] ABSTRACT

The electric current leaving an electrolytic aluminum reduction cell leaves the long sides of the cell via cathode bars connected to at least four asymmetrical busbars which lead to the anode beam of the next cell. These busbars which lead the current off in opposite directions are arranged on both sides of the cell at various distances, whereby however, the distances of two diametrically positioned busbars from the central axis of the cell are equal.

4 Claims, 4 Drawing Figures

ELECTROLYTIC REDUCTION CELL WITH COMPENSATING COMPONENTS IN ITS MAGNETIC FIELD

BACKGROUND OF THE INVENTION

The present invention is drawn to an electrolytic cell for the production of aluminum by fused salt electrolysis wherein electric current leaves the long sides of the cell via cathode bars which are connected to at least four asymmetric busbars which lead to the anode beam of the next cell.

Aluminum is produced from aluminum oxide by electrolysis wherein the aluminum oxide is dissolved in a fluoride melt being made up in part of cryolite ($Na_3AlF_6$). The aluminum deposited in the process collects under the fluoride melt on the carbon floor of the cell where the surface of the liquid aluminum forms the cathode of the cell. Anodes, which are made of amorphous carbon in conventional processes, dip into the melt from above. Oxygen forms at the anodes as a result of the electrolytic decomposition of the aluminum oxide and, when carbon anodes are used, combines with the carbon to form CO and $CO_2$. The electrolytic process takes place at a temperature range of approximately 900° to 1000° C.

The well known principle of a conventional reduction cell with pre-baked anodes is illustated in FIG. 1 which shows a vertical section through a part of a cell running in the longitudinal direction. The steel tank 12, which is lined with insulation 13 made of heat resistant, thermally insulating material, and carbon 11 contains the fluoride melt 10 which is the electrolyte. The aluminum 14 deposited at the cathode lies on the carbon floor 15 of the cell. The surface 16 of the liquid aluminum serves as the cathode. Embedded in the carbon lining 11, and running across the cell, are iron cathode bars 17 which conduct the direct electrical current from the carbon lining 11 of the cell to the side of the cell. Amorphous carbon anodes 18, which conduct the direct current to the electrolyte, dip into the fluoride melt 10 from above. The anodes are connected securely to the anode beam 21 by means of conductor rods 19 and clamps 20.

The electrical current flows from the cathode bars 17 of one cell via busbars, which are not shown here, to the anode beam 21 of the next cell. From the anode beam it flows to the cathode bars 17 of the cell via the anode rods 19, the anodes 18, the electrolyte 10, the liquid aluminum 14 and the carbon lining 11. The electrolyte 10 is covered with a crust 22 of solidified melt and a layer of aluminum oxide 23 on top of the crust. In practice there are spaces 25 between the electrolyte 10 and the solidified crust 22. Also at the side walls of the carbon lining 11 a crust of solidified electrolyte forms a border 24. The border 24 delimits the horizontal dimension of the bath comprising liquid aluminum 14 and electrolyte 10.

The distance d between the bottom face 26 of the anode and the surface 16 of the aluminum, also called the interpolar spacing, can be varied by raising or lowering the anode beam 21 with the jacking facilities 27 mounted on columns 28. By setting the jacking facilities 27 into operation, all the anodes are raised or lowered simultaneously. Apart from this, the vertical position of each anode can be altered individually in a conventional manner via the clamp 20 on the anode beam 21.

The electrolytic cells are usually arranged in rows, either longitudinally or transversally. The current for electrolysis flows first of all through the cells of one row, which are connected in series, and then flows back to the transformer unit through one or more neighboring rows of cells.

This feeding back of the electric current produces a vertical magnetic scattering $H_z$, which can be estimated by the following equation which applies in general to conductors carrying an electrical current:

$$H_z = \frac{I}{2\pi r} \; [A/cm]$$

where I is the current in Ampere, and r is the average distance in cm to the neighboring series of cells.

The magnetic fields produced by the neighboring series of cells considerably disturb the desired magnetic symmetry of a reduction cell, as they combine with the magnetic fields in certain parts of the cell and in other parts cancel out the fields to a certain extent. The magnetic field produced by superposition of the different fields produces in the metal in the cell an asymmetry which, together with the horizontal components of current in the cell, is responsible for the streaming of the metal, doming and fluctuations in the metal. As all these phenomena have negative effects on the process, it is of great importance to be able to influence the distribution of the magnetic fields with the help of theoretical considerations and practical experience.

It is known that the distribution of the field in the metal in the cell can be controlled by appropriate choice of current distribution close to and around the cell. It has therefore been possible to dimension and achieve symmetry in 210 kA cells both with respect to current density and magnetic fields. However, it is necessary to consider the field distribution, not only due to effects in the immediate vicinity, but also with respect to more distant fields from neighboring rows of cells. It is in fact difficult to compensate adequately for the more distant field effects.

The expert knows, from Erzmetall, 27/10 (1974), 464, that when cells are extremely symmetrical, asymmetry must be introduced to prevent fluctuations occuring in the aluminum on the floor of the cell. This is brought about by separating the cathode aluminum conductor bars at a certain place, without depriving the cell of electric current. The separation takes place such that equal numbers of cathode bars with respect to the transverse axis of the cell deliver the current to the sides along the length of the cell.

This known process is described in FIG. 2 in which the direct current of one cell 30 is led via cathode bars 17 and cathode busbars 31 to the anode beam of the next cell, not shown here. A busbar 31 is separated at 32 which produces an asymmetry with respect to the transverse axis 33 in the cathode connections. Because of the separation, an additional magnetic field directed upwards is produced, as a result of which the magnetically induced streaming of the liquid metal can in fact be eliminated.

The patent DE-OS No. 26 53 643 describes a compensation of magnetic fields whereby the ends of the cathode bars are connected in different numbers, at least on one side of a transversely positioned cell, to the busbar leading to the anodes of the next cell. This has, with respect to creating an additional magnetic field, the same effect as separating the busbars.

In both the above cases a disadvantage arises in that the additional field which is to be produced is reduced in the next cell in the series.

It is therefore the principal object of the present invention to develop an electrolytic cell for the production of aluminum in which the interfering magnetic field from the neighboring series of cells is reduced or eliminated without impairing the superimposed magnetic field in the next cell in the series.

SUMMARY OF THE INVENTION

The foregoing object is achieved by way of the present invention wherein cathode busbars conducting the current in opposite directions on one longitudinal side of the cell are positioned at various distances D,d from the longitudinal axis of the cell, and the busbars on the other longitudinal side of the cell are positioned at various distances D',d' from the longitudinal axis of the cell, with the busbars at the greater spacing D,D' or the busbars at the shorter spacing d,d' lying diametrically opposite each other, and the displacements D—d or D'—d' of the busbars arranged such that, depending on the position of the neighboring series of cells, in the electrolytic cell there results an additional magnetic field, calculated according to a method known in electronics, which is directed counter to the interfering magnetic field from the neighboring series of cells.

In a preferred embodiment of the present invention the displacements of the busbars on the same longitudinal side of the cell are so large that the additional magnetic field produced by these displacements is as large as the opposing interfering magnetic field from the neighboring series of cells.

It is useful to have the more distantly spaced busbars at the same distance from the longitudinal axis, and likewise the other diametrically positioned closer-lying busbars also at an equal distance from that axis. This is, however, not absolutely necessary, the following variations are possible (a) The longer distances and the shorter distances are different on both sides of the cell.

(b) The longer distances are equal, and the shorter distances are different.

(c) The longer distances are different and the shorter distances are equal.

The asymmetry produces in accordance with the present invention can be produced, thanks to the diametrically opposite longer and shorter spacing, in that each busbar is connected to an equal number (i.e. half) of the cathode bars on one long side of the cell. In accordance with another version of the present invention, diametrically opposite cathode busbars can be connected to equal numbers of cathode bars other than half of the total number on one long side of the cell.

BRIEF DESCRIPTION OF THE DRAWINGS

The present invention will now be explained in greater detail with the help of the following illustrative drawings.

DETAILED DESCRIPTION

Figure 1:
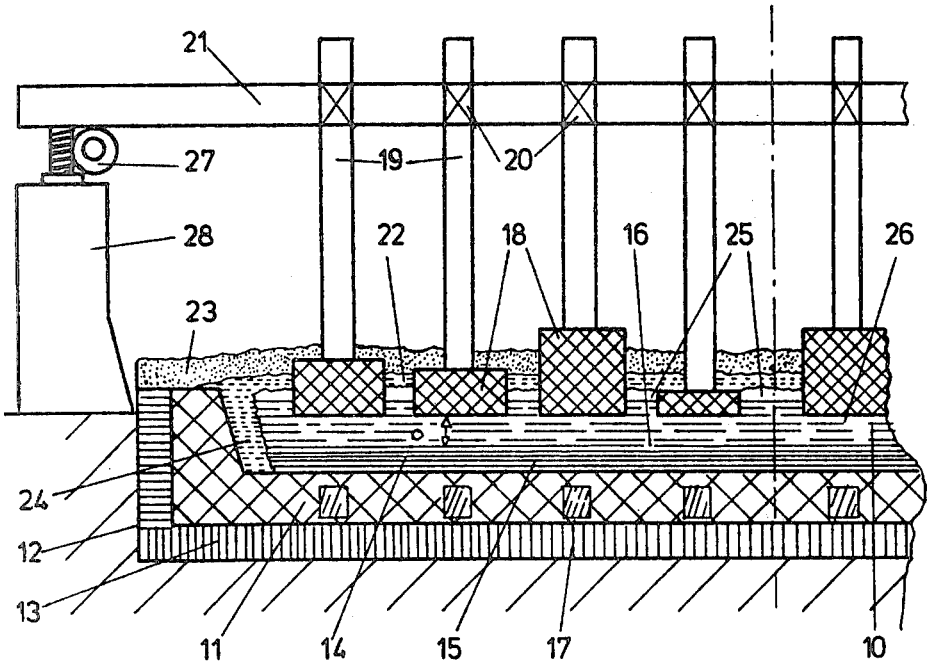
FIG. 1: Is a partial cross sectional view of a typical aluminum reduction cell.
Figure 2:
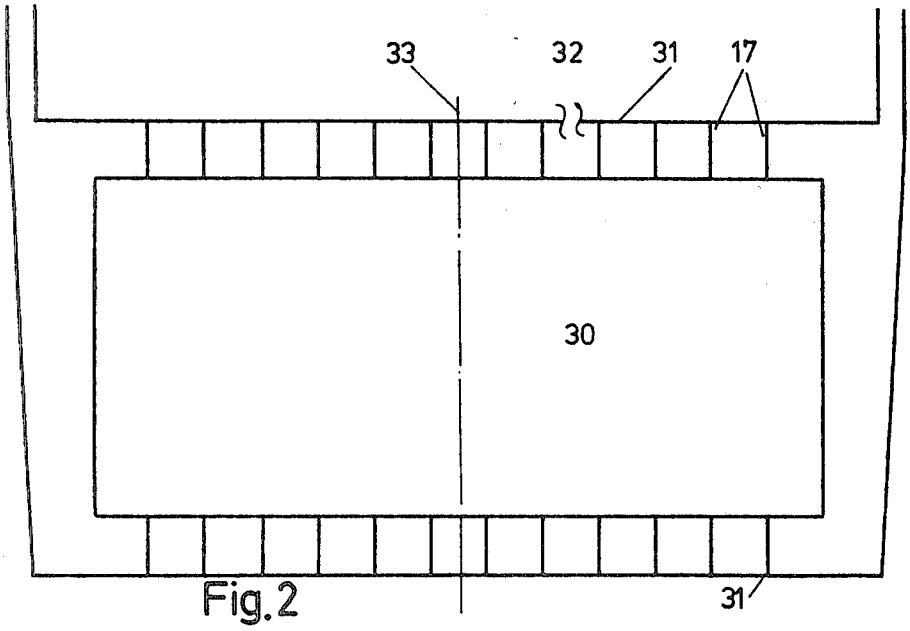
FIG. 2: Represents a known prior art process for reducing interfering magnetic fields.
Figure 3:
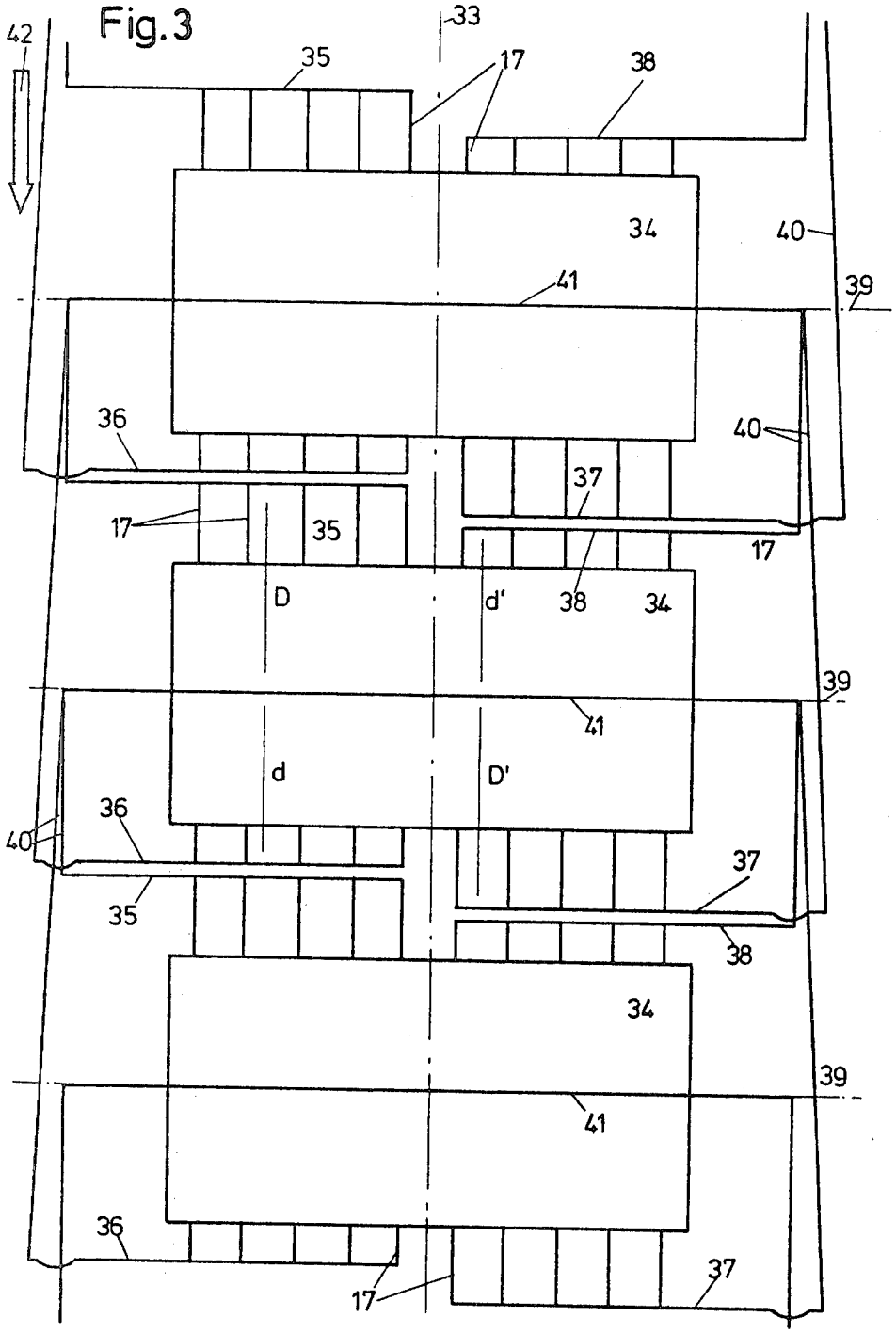
FIG. 3: Illustrates a first embodiment of the present invention wherein three cells, lying transversely, have each cathode busbar connected to the ends of five cathode bars i.e. each to a quarter of the total number of cathode bars.
Figure 4:
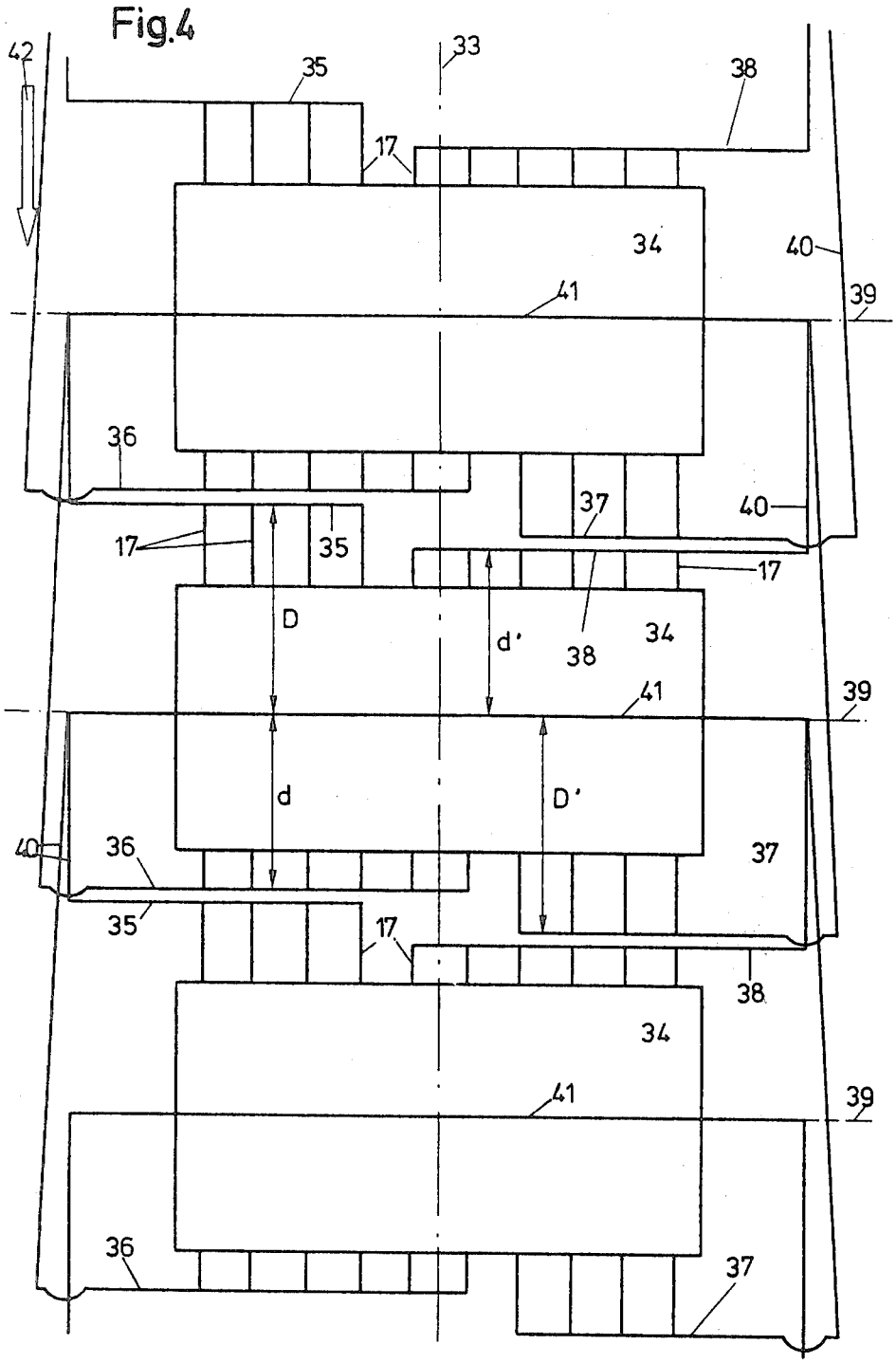
FIG. 4: Illustrates three cells, lying transversely as in FIG. 3, however with two diametrically positioned cathode busbars connected to the ends of six cathode bars, and the two other diametrically situated cathode busbars connected to the ends of four cathode bars.

Referring to FIGS. 3 and 4, the transverse cells 34 arranged in series are all constructed the same way. The busbars 35–38 are connected to the cathode bars 17 with the busbar 35 at a distance D from the longitudinal axis 39, busbar 36 at a distance d, busbar 37 at a distance D', and busbar 38 at a distance d' from the longitudinal axis 39. These cathode busbars 35–38 are connected to the anode beam 41 of the next cell in the same series. The position of the neighboring series of cells is indicated by numeral 42. This produces in cell 34 magnetic interference which is directed from the bottom towards the top. If the neighboring series of cells were to lie on the opposite side, it would produce a magnetic field which would be directed from the top to the bottom.

The distance of the cathode busbar 35 from the long axis 39 of the cell is D—d larger than the corresponding distance of the busbar 36 from the same axis 39. Likewise, the distance of the busbar 37 from the long axis of the cell is D'—d' larger than the corresponding distance of busbar 38 from that axis. In the case discussed D=d' and d=d'.

Instead of being one single busbar, 35 can comprise a series of parallel busbars; the same holds for 36, 37 and/or 38.

From the laws of electricity it is known that the cathode busbars on opposite sides of the longitudinal axis of the cell viz., 35, 37 and 36, 38 respectively induce a vertical magnetic field which is directed from the top towards the bottom and which is not cancelled by the corresponding cathode busbar of the previous cell in the series, as these busbars are at a greater distance to the longitudinal axis of the cell than the busbars of the same cell.

If each quarter of the cell is looked on as a unit in itself, the displacement of the cathode busbars towards or away from the cell strengthens the desired magnetic effect in the previous and subsequent cell in the series.

EXAMPLE

In this example the vertical magnetic interference from a neighboring series of cells is calculated and also the effect of the displacing the cathode busbars 35–38 in accordance with the present invention:

Using the formula:

$$H_z = \frac{I}{2\pi r}$$

a magnetic interference $H_z$ of 7.1 A/cm is obtained for a current I=160 kA and a spacing of 36 m between rows of cells.

The distance between two longitudinal axes 39 is 700 cm. In this case the distance of the cathode busbars 35 and 37 from the longitudinal axis of their cells are equal viz., 400 cm. Also the busbars 36 and 38 situated closer to the cell are, in this case, at the same distance of 270 cm to their respective cells. This results, for example on the longitudinal axis 39 on the narrow side of the cell, in a downward pointing magnetic field $H_z$ being developed, the strength of which is calculated as follows:

$$H_z = K\left(\frac{1}{270} + \frac{1}{300} - \frac{1}{400} - \frac{1}{430}\right) = K \cdot 0{,}0022264 = 7.1\ A/cm$$

K, which has the dimension of Ampere (A), calculated via known laws of electronics for a 160 kA cell, has a value of 3185 for a conductor of limited length.

With the arrangement of the busbars described in this example a magnetic interference of 7.1 A/cm from the neighbouring row of cells can be fully compensated.

What is claimed is:

1. In an aluminum potline for the production of aluminum by fused salt electrolysis including a plurality of electrolytic cells arranged in series relationship in at least two rows, each of said cells having a longitudinal axis, wherein electrical current is passed from the cathode bars from one cell to the anode beam of the next cell via a plurality of busbars, the improvement comprising:

at least four asymmetrical busbars for leading the current off in opposite directions, at least two of said busbars being at one side of cell at a first and second distance from the longitudinal axis of said cell and at least the other two of said busbars being on the other side of said cell at a first and second distance from the longitudinal axis of said cell whereby said first distance is greater than said second distance and the busbars at said first distance and said second distance are diametrically opposite each other and the displacement of said busbars are such that a magnetic field is produce in the cell which opposes the magnetic interference induced by the neighboring row of cells.

2. An aluminum potline according to claim 1, wherein the displacements of said busbars are so large that the magnetic field and the counteracting magnetic interference from the neighboring series of cells are of equal magnitude.

3. An aluminum potline according to claim 2, wherein the first distances and/or the second distances from the longitudinal axis are equal in size.

4. An aluminum potline according to claim 3 wherein the busbars leading the electric current off in opposite directions are connected at least on one long side of the cell to the same number of the ends of cathode bars.

* * * * *

UNITED STATES PATENT AND TRADEMARK OFFICE

CERTIFICATE OF CORRECTION

PATENT NO. : 4,224,127

DATED : September 23, 1980

INVENTOR(S) : Wolfgang Schmidt-Hatting

It is certified that error appears in the above-identified patent and that said Letters Patent are hereby corrected as shown below:

In Column 5, claim 1, line 22, after "of" insert --said--.

In Column 6, claim 1, line 7, change "produce" to read --produced--.

Signed and Sealed this

*Seventeenth* Day of *February 1981*

[SEAL]

*Attest:*

RENE D. TEGTMEYER

*Attesting Officer*

*Acting Commissioner of Patents and Trademarks*